United States Patent [19]

Vermillion

[11] Patent Number: 4,459,790

[45] Date of Patent: Jul. 17, 1984

[54] WALL PANEL LOCKING MECHANISM

[75] Inventor: Eugene F. Vermillion, Columbus, Ohio

[73] Assignee: The Columbus Show Case Company, Columbus, Ohio

[21] Appl. No.: 520,428

[22] Filed: Aug. 4, 1983

[51] Int. Cl.[3] ..... E04B 1/60

[52] U.S. Cl. ..... 52/764; 52/780; 52/508; 52/241

[58] Field of Search ..... 52/510, 243, 241, 127.5, 52/127.6, 126.3, 766, 481, 508, 511, 489, 486, 775, 238.1, 764, 780

[56] References Cited

U.S. PATENT DOCUMENTS

| | | | |
|---|---|---|---|
| 2,020,502 | 11/1935 | Goddard | 52/238.1 |
| 2,081,368 | 5/1937 | Pretot | 52/489 |
| 2,158,082 | 5/1939 | Morrell | 52/481 |
| 2,766,858 | 10/1956 | Johnson | 52/481 |
| 3,332,182 | 7/1967 | Mark . | |
| 3,550,338 | 12/1970 | Satkin . | |
| 3,722,163 | 3/1973 | Satkin | 52/126.3 |
| 4,370,838 | 2/1983 | Vermillion . | |

*Primary Examiner*—John E. Murtagh
*Assistant Examiner*—Kathryn L. Ford
*Attorney, Agent, or Firm*—Rambo & Wolken

[57] ABSTRACT

Laterally spaced apart, vertically disposed studs are each provided with a pair of latch-receiving slots disposed laterally and rearwardly of a longitudinally extending, panel-separating rib. A wall panel is disposed between each pair of adjacent studs and is provided with a pair of laterally spaced apart latch members. Each latch member is positioned on the panel to be insertable in and removable from one of the latch-receiving slots on each of the adjacent studs with the wall panel in an elevated position. With the wall panel in a lowered position, the latch members cannot escape through the slots and the panel is held against the studs.

3 Claims, 3 Drawing Figures

WALL PANEL LOCKING MECHANISM

BACKGROUND OF THE INVENTION

The present invention relates to wall structures that are readily assembled from prefabricated, standardized components, and more particularly to locking mechanisms designed to releasably secure wall panels to vertically disposed studs or pilasters.

Factory-made wall paneling systems are particularly well suited for use as curtain walls that modernize and increase the merchandising potential of commercial space, and as free standing walls that partition the space into smaller units and provide more display surfaces. Typically, the need for these wall structures arises after the commercial space has been in use for some time, so it is desirable to erect them as quickly as possible with minimum disruption to the marketing activity. Since these walls are constructed with a purality of wall panels disposed between vertically elongated studs or pilasters, and since a substantial amount of merchandise may be mounted on the walls, it is important to have reliable wall panel locking mechanisms that are relatively simple to assemble and engage.

The present invention is suitable for use on, but not necessarily limited to, the curtain wall disclosed in U.S. Pat. No. 4,370,838 issued Feb. 1, 1983 and the free standing wall disclosed in U.S. Pat. No. 4,391,069 issued July 5, 1983, both to the present inventor. U.S. Pat. No. 4,370,838 discloses a panel locking mechanism comprising a latch that is rotatable between a retracted position, in which it is confined within a chamber inside a vertical stud, and an extended position, in which the opposite ends of the latch project laterally outwardly through slots formed in the stud to engage catches secured to the wall panels. U.S. Pat. No. 4,391,069 discloses a free standing wall having wall panels that are secured in the same manner to studs that are mounted in multichanneled cap and sill members. The present panel locking mechanism, in contrast, has latch members connected with the panels and slot means formed on the studs. U.S. Pat. No. 3,828,495 issued Aug. 13, 1974 to Law discloses a wall structure provided with wall panels that are rigidly secured to laterally projecting ledges formed on a panel-separating member. In contrast to the present invention, however, the Law panels are not provided with latch members that can be inserted and removed with the panel in an elevated position and that are immovable with the panel in a lowered position.

SUMMARY AND OBJECTS OF THE INVENTION

The present invention represents an improvement in a wall structure that includes at least a pair of laterally spaced apart, parallel, vertically arranged studs and a wall panel having elevated and lowered positions relative to the studs between which it is disposed. Each stud is formed with a longitudinally extending, forwardly projecting, panel-positioning rib, and at least one laterally projecting base flange spaced rearwardly on the rib. The panel is provided with front and back surfaces and with opposite verticle side surfaces that are positionable between the panel-separating ribs of the studs. The present invention basically comprises at least one latch-receiving ledge integrally formed on each of the studs intermediately of the rib and base flange, and a pair of laterally spaced apart latch members connected with the back surface of the panel in proximity to the vertical side surfaces thereof. The ledge is substantially longitudinally coextensive with the rib, is disposed laterally and rearwardly of the rib, and has a forwardly opening, latch-receiving passageway formed therein. The latch members are insertable in and removable from the passageways formed in the ledges of the pair of studs with the panel in its elevated position and immovable through the passageways with the panel in its lowered position.

A primary object of the present invention is to provide a reliable panel locking mechanism that requires no additional moving parts on either the wall panels or vertical studs. Another object of the present invention is to combine the installation of the wall panels in the upper and lower channels and the containment of the side edges of the panel against the vertical studs into a single operation. Further objects and advantages of the present invention may be more readily perceived in view of the following drawing and detailed description.

DETAILED DESCRIPTION OF THE PREFERRED EMBODIMENT

Figure 1:
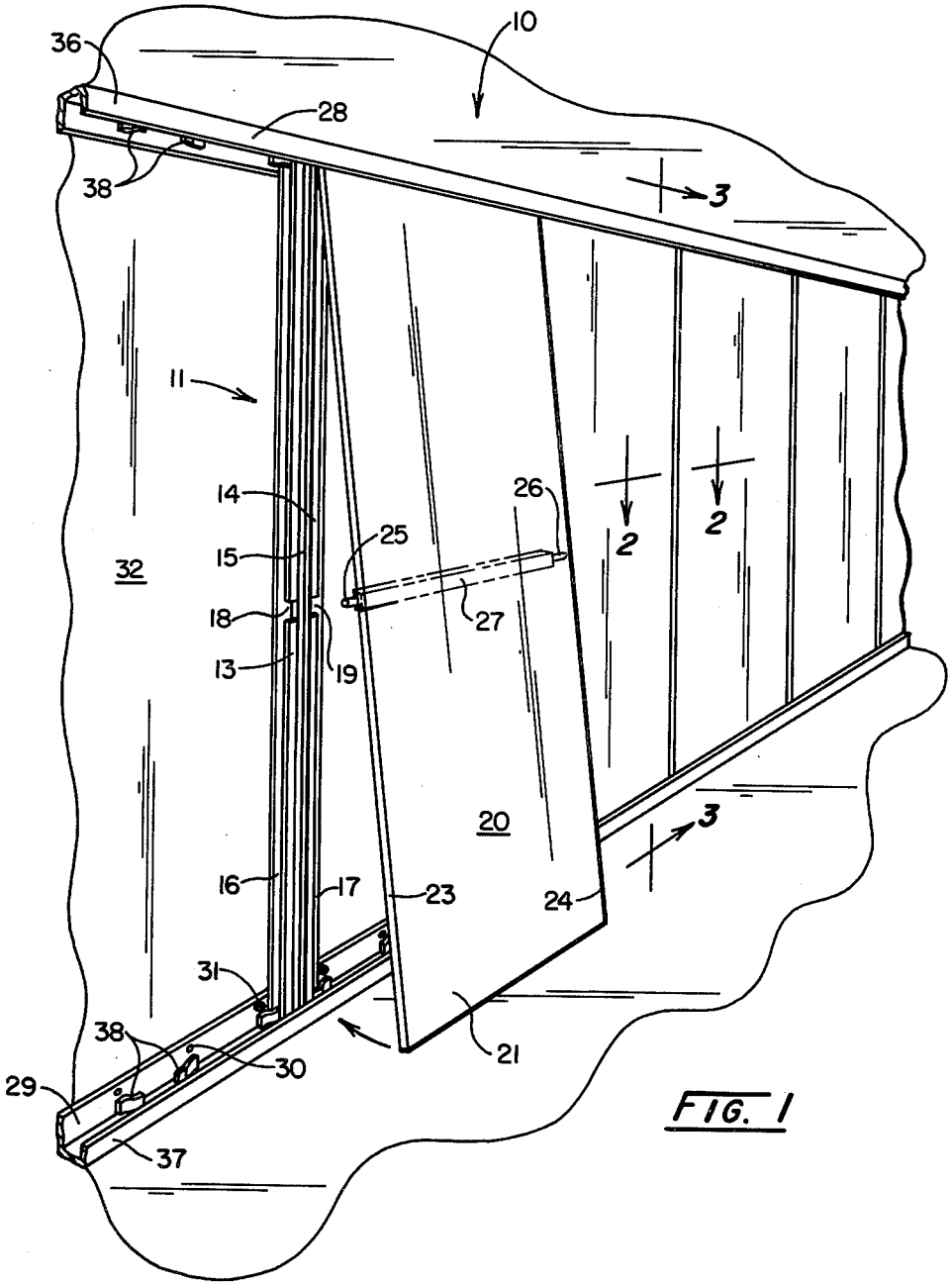
FIG. 1 is a perspective view of a curtain wall and a panel locking mechanism according to the present invention and illustrates particularly the manner in which the latch members are movable through the latch-receiving openings with the wall panel in an elevated position.

As illustrated in the drawing, the present wall panel locking mechanism may be employed on a curtain wall, generally designated 10. In addition to the present specifications, the reader may wish to refer to U.S. Pat. No. 4,370,838 issued Feb. 1, 1983 to the present inventor for further details on the construction of a curtain wall to which the present invention may be adapted. In addition, U.S. Pat. No. 4,391,069 issued July 5, 1983 to the present inventor discloses a free standing, partition wall on which the present panel locking mechanism may be employed. Other wall structures and configurations may also be adapted to employ the present invention.

The curtain wall 10 is formed from a plurality of readily assembled, prefabricated components, including a number of laterally spaced apart, parallel, vertically arranged pilasters or studs 11. The studs 11 are preferably integrally formed, metal extrusions. As best illustrated in FIG. 2, each stud is provided with a central spin 12, a pair of ledges or shelves 13 and 14 extending laterally in opposite directions from the spine 12, a panel-positioning rib 15 projecting forwardly from the intersection of the ledges 13 and 14, and a pair of base flanges 16 and 17 projecting laterally in opposite directions from the rear edge of the spine 12, all longitudinally coextensive with one another and with the stud on which they are formed. Forwardly opening, latch-receiving passageways or slots 18 and 19 (FIG. 1) are formed on the ledges 13 and 14 respectively, in laterally and rearwardly spaced relation to the panel-positioning rib 15.

Alternatively, the pilasters 11 may be formed with a pair of relatively spaced apart, panel-separating ribs (not shown), as disclosed in the above mentioned U.S. Pat. No. 4,370,838. The spaced apart ribs define a bracket-receiving channel that opens into an internal chamber for housing a bracket-anchoring strip. If the present invention were adapted to such a stud, it would be necessary to extend the ledge portions and position the latch-receiving slots laterally outwardly from their present locations so that said slots would not interfere with the internal chamber or bracket-anchoring strip. It might also be possible to provide forwardly opening passageways according to the present invention on an additional pair of shelves (not shown) projecting laterally in opposite directions from a central spine or an internal chamber and intermediately to ledges and base flanges similar to those found on the present stud.

Figure 2:
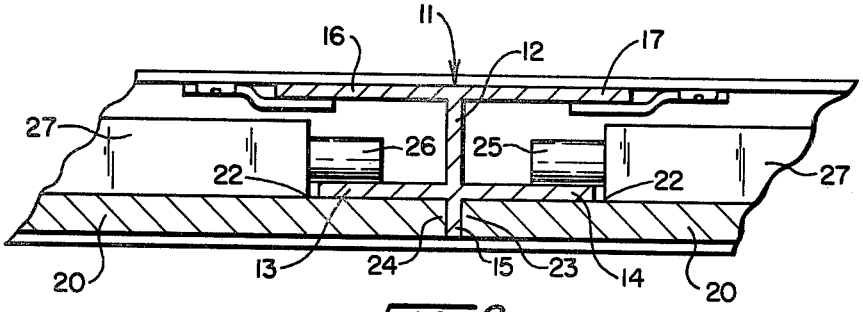
FIG. 2 is an enlarged, horizontal sectional view taken along line 2—2 of FIG. 1 and illustrates particularly the spatial relationships between the various components of the stud and wall panel according to the present invention.

As indicated in FIG. 1, the present wall structure 10 further includes a plurality of wall panels 20, each disposed between a pair of laterally spaced apart studs 11 and provided with a front surface 21, a back surface 22 (FIG. 2), and with opposite vertical side surfaces 23 and 24 that are positionable between the panel-positioning ribs 15 of the adjacent studs 11. Preferably, the laterally projecting ledges 13 and 14 and the forwardly projecting rib 15 of each stud form a pair of entrant corner seats to receive the neighboring side surfaces 23 and 24 and neighboring portions of the rear surfaces 22 of a pair of adjacent wall panels 20.

As indicated in FIGS. 1 and 2, each wall panel 20 is provided with a pair of laterally spaced apart latch members or latch pegs 25 and 26 that are connected with the back surface 22 of the panel in proximity to the vertical side surfaces 23 and 24, respectively. Each of the studs 11 and wall panels 20 is provided, respectively, with a single pair of latch-receiving slots 18 and 19 and a single pair of latch pegs 25 and 26 that are disposed approximately half of the way between the upper and lower ends of said studs and panels. It would also be possible, however, to have additional pairs of forwardly opening passageways and pegs above and below said centrally located members. Preferrably, the latch pegs or pins 25 and 26 are cylindrical, laterally projecting dowels integrally formed on or rigidly secured to opposite ends of a horizontally extending mounting member or crossbar 27 and are coaxially aligned therewith. The crossbar 27, in turn, is rigidly secured to the panel 20 and forms a portion of the rear surface 22 thereof. Alternatively, it would be possible to dispense with the rearwardly protruding mounting member and mount the latch pins directly on each panel. It would also be possible to provide each pin with an enlarged head and project it rearwardly, instead of laterally, from the mounting member and to provide the studs with keyhole-shaped slots instead of the presently configured passageways.

Figure 3:
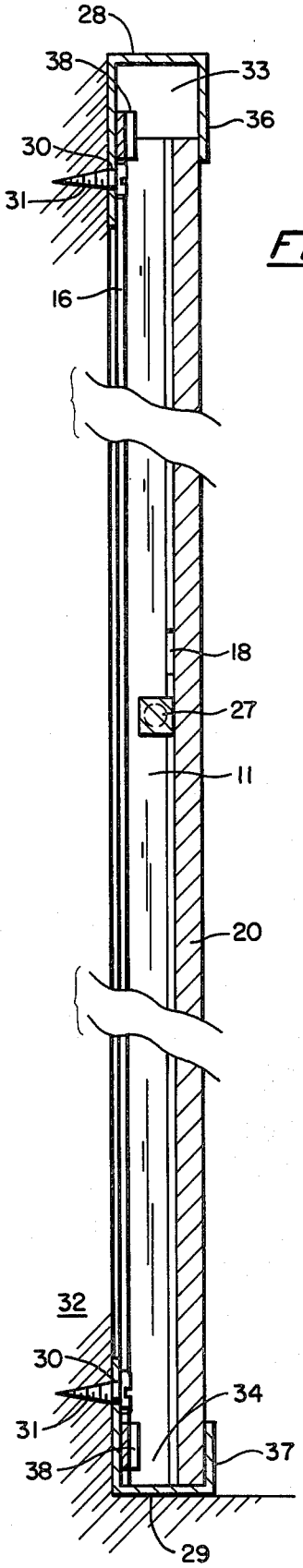
FIG. 3 is an enlarged vertical sectional view taken along line 3—3 of FIG. 1 and illustrates particularly the manner in which the latch member is engaged, with the wall panel in a lowered position, by a ledge that is formed in the stud.

As indicated in FIGS. 1 and 3, the upper and lower ends of the studs 11 and the panels 20 may be disposed, advantageously, within upper and lower channel-form frame members 28 and 29, in a manner disclosed in the above-mentioned U.S. Pat. No. 4,370,838, or within multi-channeled cap and sill members (not shown), as disclosed in U.S. Pat. No. 4,391,069. The upper and lower frame members 28 and 29 are formed at longitudinally spaced intervals with fastener-receiving openings 30 through which nails, bolts or screws 31 may extend to secure the frame members to an adjacent wall surface 32. The upper and lower frame members 28 and 29 possess generally J-shaped cross sections and are arranged to define a pair of longitudinally extending, opposed channels 33 and 34 opening toward one another.

As indicated in FIG. 3, an outer, downturned web or lip 36 of the upper frame member 28 is substantially wider than the corresponding outer, upturned web or lip 37 of the lower frame member 29. Thus, the upper channel 33 is substantially deeper than the lower channel 34. Each of the frame members is provided at longitudinally spaced intervals with sets of horizontally spaced, stud-locating fingers or clips 38 (FIG. 1). The depth of the upper channel 33 is such that the upper end of the stud 11 may be raised within the upper channel a distance sufficient to permit the lower end of the stud to be lifted over the lip 37 and the stud-locating clips 38 of the lower frame member 29. Accordingly, the upper end portion of the stud is angled into the channel 33 of the upper frame member 28 to engage the base flanges 16 and 17 within the stud-locating clips 38. The stud is then elevated so that its lower end clears the lip and clips of the lower frame member and is finally lowered to engage the base flanges 16 and 17 with the clips 38 of the lower frame member.

The height of the wall panels 20 corresponds to the height of the studs, so said panels may be inserted into the upper and lower channels of the frame members in a manner similar to that of the studs. As indicated in FIG. 1, the upper edge of the panel is inserted into the channel of the upper frame member 28. Upper portions of the panel's side surfaces 23 and 24 and adjacent portions of the back surface are slidably mounted in the entrant corner seats formed by the ribs 15 and flanges 13 and 14 of adjacent studs. The panel is then elevated relative to the now seated studs so that the latch pins 25 and 26 are horizontally aligned with the latch-receiving slots 19 and 18 in the adjacent studs that received the vertical side edges 23 and 24 of said panel. With the panel in an elevated position, the lower end thereof is swung into vertical alignment with the channel of the lower frame member, so that the latch pins are inserted in their respective latch-receiving slots. The panel is then lowered relative to the seated studs so that, as indicated in FIG. 3, the lower end of said panel is seated in the lower channel 34 and the crossbar 27, as well as the latch pins, lie below the latch-receiving slots of the studs. As indicated in FIG. 2, the pins 26 and 25 lie rearwardly of the ledges 13 and 14 and are therefore immovable through the slots with the panel in its lowered position. To remove the panel, a worker grasps the panel at a suitable hand hold (not shown), lifts it into an elevated position, withdraws the lower end, thereby withdrawing the latch pins from the slots, and lowers the panel, thereby withdrawing the upper end from the upper channel.

In this manner, a panel locking mechanism may be provided that entails very few parts and no additional moving pieces, that is engaged and disengaged simultaneously with the movement of the panel, and that is safe and reliable. While a single preferred embodiment of the invention has been illustrated and described in detail, it will be understood that various modifications in details of construction and design may be resorted to without departing from the spirit of the invention or the scope of the following claims.

I claim:

1. In a wall structure that includes a pair of laterally spaced apart, parallel, vertically arranged studs, each formed with a longitudinally extending, forwardly projecting, panel positioning rib and at least one laterally projecting base flange spaced rearwardly of said rib, and a panel disposed between the studs and provided with front and back surfaces and with opposite vertical side surfaces positionable between the panel-positioning ribs of said studs, said panel having elevated and lowered positions relative to said studs, a wall panel locking mechanism comprising:

(a) at least one latch-receiving ledge integrally formed on each of said studs intermediately of the rib and base flange, said ledge being substantially longitudinally coextensive with and disposed laterally and rearwardly of said rib and having a forwardly opening, latch-receiving passageway formed therein; and (b) at least one pair of laterally spaced apart latch members connected with the back surface of the panel in proximity to the vertical side surfaces thereof, said latch members being insertable in and removable from the passageways formed in the ledges of said pair of studs with said panel in its elevated position and immovable through said passageways with said panel in its lowered position.

2. Wall panel locking mechanism according to claim 1, wherein the stud is integrally formed with a pair of longitudinally coextensive ledges disposed rearwardly and laterally on opposite sides of the panel-positioning rib, each of said ledges being formed with a forwardly opening latch-receiving passageway.

3. Wall panel locking mechanism according to claim 1, wherein said latch members project from at least one rearwardly protruding mounting member on the back surface of the panel.

* * * * *